US005337913A

United States Patent [19]

Fukuda

[11] Patent Number: 5,337,913

[45] Date of Patent: Aug. 16, 1994

[54] LUNCH BOX WITH UTENSIL POCKET

[75] Inventor: Takeshi Fukuda, Osaka, Japan

[73] Assignee: Dart Industries Inc., Deerfield, Ill.

[21] Appl. No.: 37,631

[22] Filed: Mar. 26, 1993

[51] Int. Cl.[5] ..... B65D 45/16

[52] U.S. Cl. ..... 220/326; 220/575; 220/556

[58] Field of Search ..... 206/216, 217, 541, 542; 220/324, 326, 281, 282, 555, 553, 556, 505, 575, 574.1

[56] References Cited

U.S. PATENT DOCUMENTS

| | | | |
|---|---|---|---|
| D. 193,253 | 7/1962 | Stehl et al. . | |
| D. 245,579 | 8/1977 | Jewell . | |
| 1,138,288 | 5/1915 | Harper | 220/575 |
| 2,307,087 | 1/1943 | White . | |
| 2,819,813 | 4/1956 | Larsen . | |
| 2,935,108 | 5/1960 | Hall | 220/324 |
| 3,010,600 | 11/1961 | Larsen . | |
| 3,207,566 | 9/1965 | Garieco et al. | 220/505 |
| 3,338,389 | 8/1967 | Sellen et al. | 220/505 |
| 3,850,333 | 11/1974 | Reichert | 220/556 |
| 3,909,092 | 9/1975 | Kiernan | 220/505 |
| 4,212,415 | 7/1980 | Neely | 220/324 |
| 4,344,646 | 8/1982 | Michel | 220/326 |
| 4,640,416 | 2/1987 | Northrup et al. | 220/324 |
| 4,901,882 | 2/1990 | Goncalves . | |
| 4,969,573 | 11/1990 | Dupuis et al. . | |
| 4,986,438 | 1/1991 | Borst | 220/324 |
| 5,029,723 | 7/1991 | Lo . | |
| 5,033,634 | 7/1991 | Batchelor et al. . | |
| 5,042,712 | 8/1991 | De Roseau | 220/574.1 |
| 5,050,762 | 9/1991 | Giorgi . | |
| 5,163,578 | 11/1992 | Eitreim et al. | 220/505 |
| 5,205,413 | 4/1993 | Cautereels et al. | 220/324 |
| 5,205,431 | 4/1993 | Zinnbauer | 220/281 |

*Primary Examiner*—Stephen Castellano
*Attorney, Agent, or Firm*—John A. Doninger

[57] ABSTRACT

A lunch box including a tray and a removable lid with a rear, separable hinge assembly and a forward manually releasable latch assembly. The latch assembly includes a front panel on the tray with longitudinally spaced pressure pads and forwardly projecting detents which engage with corresponding detents on the depending front wall of the lid. Simultaneous rearward pressure on the two pressure pads rearwardly release the tray detents from the lid detents and free the lid for removal.

8 Claims, 4 Drawing Sheets

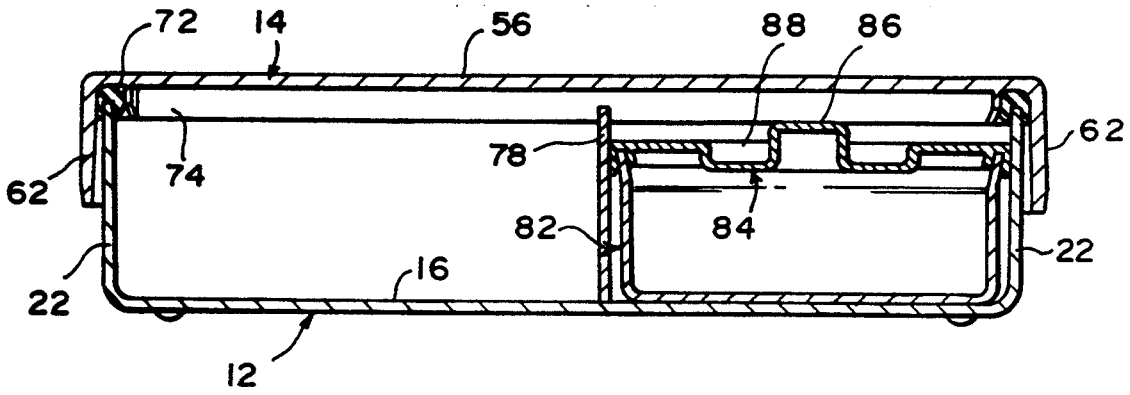
FIG. 7
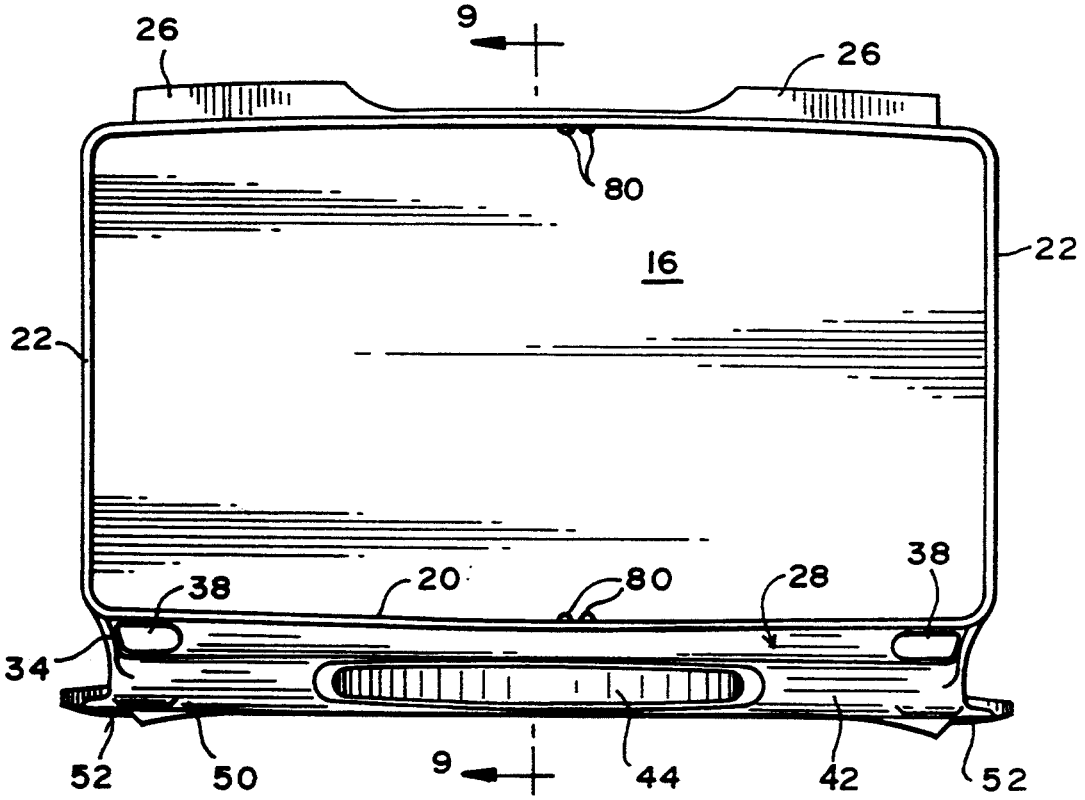
FIG. 8
FIG. 9
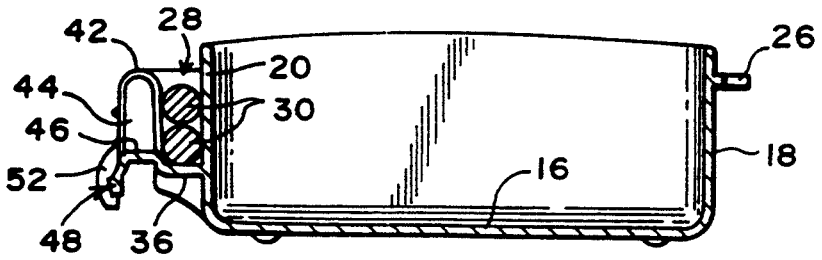

LUNCH BOX WITH UTENSIL POCKET

BACKGROUND OF THE INVENTION

Lunch boxes are normally rather bulky items with hinge-mounted lids which, while acceptable for the containing and carrying of foodstuffs, are not particularly attractive, not conveniently carried and do not lend themselves for use as the actual serving dish for the food.

Also, the more commonly known lunch boxes frequently utilize rather elaborate latch mechanisms and hinge structures which are not necessarily easy to operate or effective in retaining the closure.

Another problem frequently encountered in known lunch boxes is the lack of any provision for the convenient accommodation of eating utensils.

SUMMARY OF THE INVENTION

The lunch box of the present invention will be particularly acceptable for adult use in that the lunch box is of a rather streamline compact configuration easily carried within a briefcase, provides an attractive appearance, and is not in fact readily discernible as a lunch box.

It is significant that the lunch box includes a lid which is completely removable, allowing the tray to be used as a serving dish for the direct consuming of foodstuffs therefrom. This is particularly desirable when the foodstuff is other than hand food such as sandwiches and the like. An appropriate sealing gasket is incorporated into the lid to effectively seal the lunch box both before and after consuming the foodstuff whereby preservation of the foodstuff is assured and the escape of any aromas associated with the residue remaining is effectively avoided.

The distinctive latch mechanism or assembly of the invention is integrally formed with the tray and lid and, while mechanically simple and trouble free, is unique in its construction and the manner in which a positive latching of the lid to the tray is provided. The latch mechanism, comprising dual latches, while easy to manipulate, substantially precludes accidental or inadvertent release of the lid. As above indicated, upon release of the latch mechanism, the lid itself is completely removable from the tray.

A further significant feature of the invention is the provision of a separate or auxiliary storage compartment or pocket for the eating utensils, for example chopsticks. The utensils are retained exterior of the food compartment yet within the confines of the mounted lid.

Structurally, the tray of the lunch box is preferably rectangular with the lid of a complementary configuration. The top wall of the lid includes a defined groove which receives the sealing gasket for engagement with the peripheral upper edge of the tray to effect a positive seal.

A disengagable rear hinge assembly cooperates with the latch mechanism for releasable retention of the lid on the tray.

The disengagable rear hinge assembly includes rearwardly projecting tabs on the rear wall of the tray and elongate slots on the lid which loosely receive the tabs whereby a degree of pivotal movement is allowed and a sliding disengagement easily effected.

The latch assembly includes a depending front panel on the tray which is forwardly spaced from the generally parallel the front wall of the tray. The front panel includes manually depressible end flap portions with forwardly projecting detents thereon which engage similar inwardly directed detents on the front wall of the lid whereby inward pressure on the end flap portions disengage the detents and allow an upward pivoting of the front of the lid for complete removal by disengagement of the rear hinge assembly.

The utensil pocket is formed inward of the latch front panel and is defined by the front wall of the tray and a generally parallel pocket wall forward thereof, whereby the utensils are retained outward of the food compartment while at the same time being confined within the overlying lid.

Other features and advantages of the invention, considered to reside in the details of the invention, will become apparent as the invention is more fully hereinafter presented.

BRIEF DESCRIPTION OF THE DRAWINGS

FIG. 7 is a cross sectional view taken substantially on a plane passing along line 7—7 in FIG. 1;

FIG. 8 is a top plan view of the tray; and

FIG. 9 is a cross sectional view taken substantially on a plane passing along line 9—9 in FIG. 8.

DESCRIPTION OF PREFERRED EMBODIMENT

Figure 1:
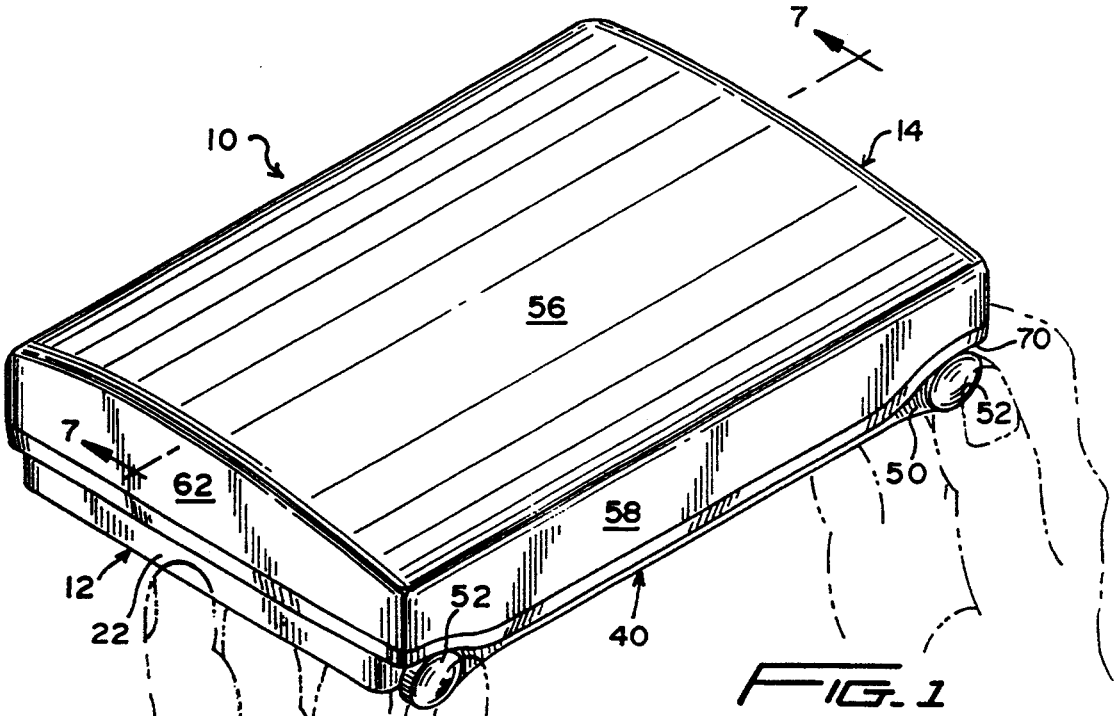
FIG. 1 is a top front perspective view of the lunch box illustrating one manner in which the lid is released.

The lunch box 10 basically comprises a tray 12 and lid 14, both preferably rectangular and of complementary configurations for telescopic reception of the lid 14 over the tray generally as illustrated.

The tray 12 defines an interior upwardly opening compartment and comprises a base or bottom wall 16 with generally parallel rear and front walls 18 and 20, and opposed generally parallel side walls 22, all integrally formed with and extending upward from the base or bottom wall 16. A continuous upper edge 24 is formed by the upstanding walls.

Integral with the rear tray wall 18 and extending longitudinally thereon in closely spaced relation below the upper edge 24 is a pair of elongate tabs 26.

A utensil receiving pocket 28, for chopsticks 30 or other appropriate utensils, is defined forward of and in conjunction with the front wall 20. The pocket 28 is generally coextensive with the tray front wall 20, and includes a pocket wall 32 substantially parallel to and spaced forward of the front wall 20. The pocket wall 32 is integrally joined to the front wall 20 by opposed end walls 34 and a full length bottom wall 36, preferably with drainage apertures 38 therein adjacent the opposed end walls 34.

The tray includes a component of the latch assembly comprising a front latch panel 40 forwardly spaced from the pocket wall 32 and extending substantially coextensive therewith. The upper edge of the front panel is integrally joined to the upper edge of the pocket wall 32 by an arcuate bight portion 42 which, while retaining the front panel 40 generally parallel or slightly forwardly diverging relative to the pocket wall 32, also, as best seen in FIG. 6, allows for a resiliently resisted inward flexing of the front panel, or portions thereof, toward the pocket.

Figure 3:
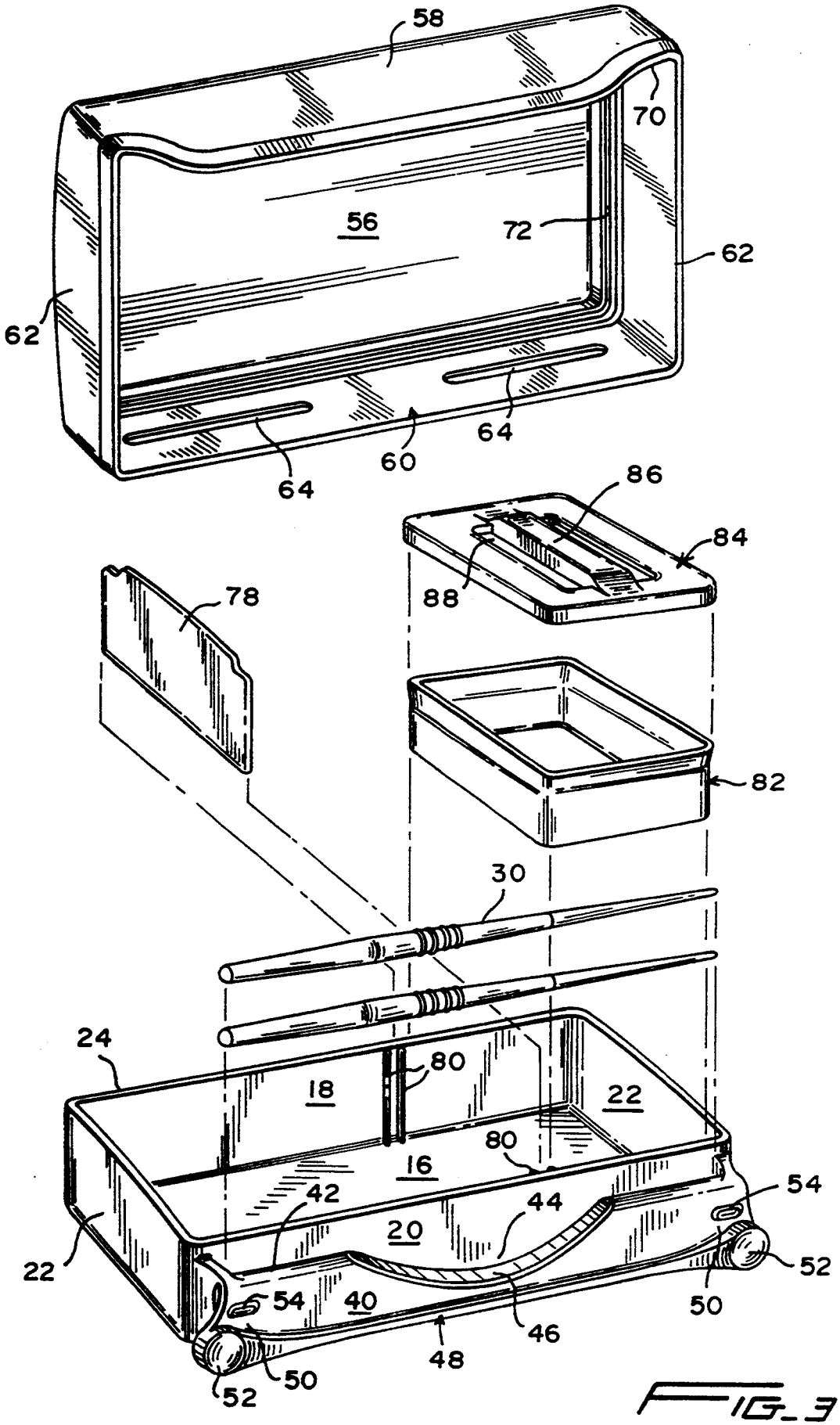
FIG. 3 is an exploded perspective view of the various components of the lunch box.

In order to facilitate access to pocket-received utensils, such as the chopsticks 30, and noting FIGS. 3 and 9 in particular, the pocket wall 32 and latch panel 40, for a substantial portion centrally along the length thereof, are downwardly relieved to define a concave recess 44 with the upper edges of the pocket wall 32 and panel 40 integrally joined by an arcuate top panel 46 which centrally interrupts the upper edge-joining bight portion 42. As will be appreciated, the formed recess 44 allows direct access to the utensils which are otherwise completely concealed and retained within the opposed longitudinal end portions of the pocket 28.

The front panel 40, along the lower edge portion thereof, is provided with an integral full length reinforcing rib 48. The rib 48, at the opposed end portions thereof, flares outwardly and terminates in a pair of end pressure pads 52 formed with thumb-receiving recesses or depressions. As illustrated, the opposed ends of the front panel 40 project slightly longitudinally outward beyond the corresponding end walls 34 of the pocket 28.

Figure 6:
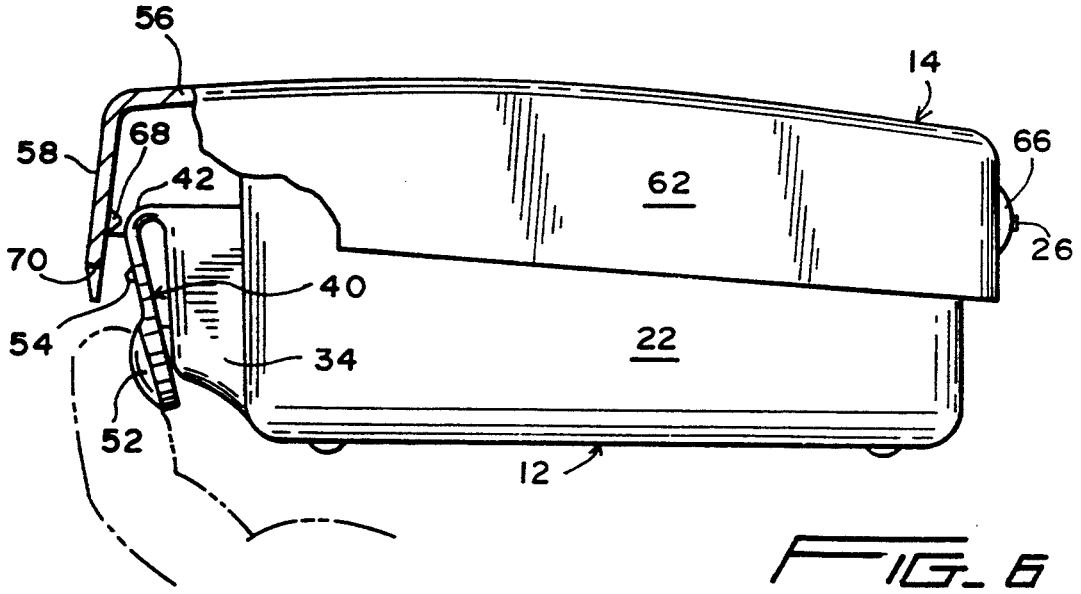
FIG. 6 is a view similar to FIG. 5 illustrating a release of the latch assembly.

As will be appreciated, the centrally formed recess 44 will rigidify this central portion of the front panel 40 with the opposed longitudinal end portions of the panel 40 forming end flaps or panel portions 50 which, in the manner suggested in FIG. 1 and illustrated in FIG. 6 are readily rearwardly or inwardly deflected or flexed upon the application of manual pressure.

Each of these end flap portions 50 includes a locking lug 54 integrally projecting from the forward face of the front panel 40 generally vertically between the corresponding pressure pad 52 and upper edge connecting bight portion 42 whereby, for purposes to be explained subsequently, upon inward pressure on the pressure pad 52, the corresponding locking lug 54 is inwardly or rearwardly retracted. In light of both the length of the front panel 40 and the rigidifying effect of the central access recess 44, pressure on one pressure pad 52 will normally only retract the corresponding lug. Retraction of both lugs 54 will require the application of thumb pressure to both pressure pads, preferably simultaneously.

Referring now more specifically to the lid 14, this lid includes a top wall 56 with integral depending front and rear walls 58 and 60, and opposed side walls 62. The lid rear and side walls 60 and 62, in the closed lunch box 10, overlie and are positioned immediately outward of the respective rear and side walls 18 and 22 of the tray 12. The front wall 58 of the lid overlies and is closely received immediately outward over the front panel 40 of the latching component of the tray.

Figure 2:
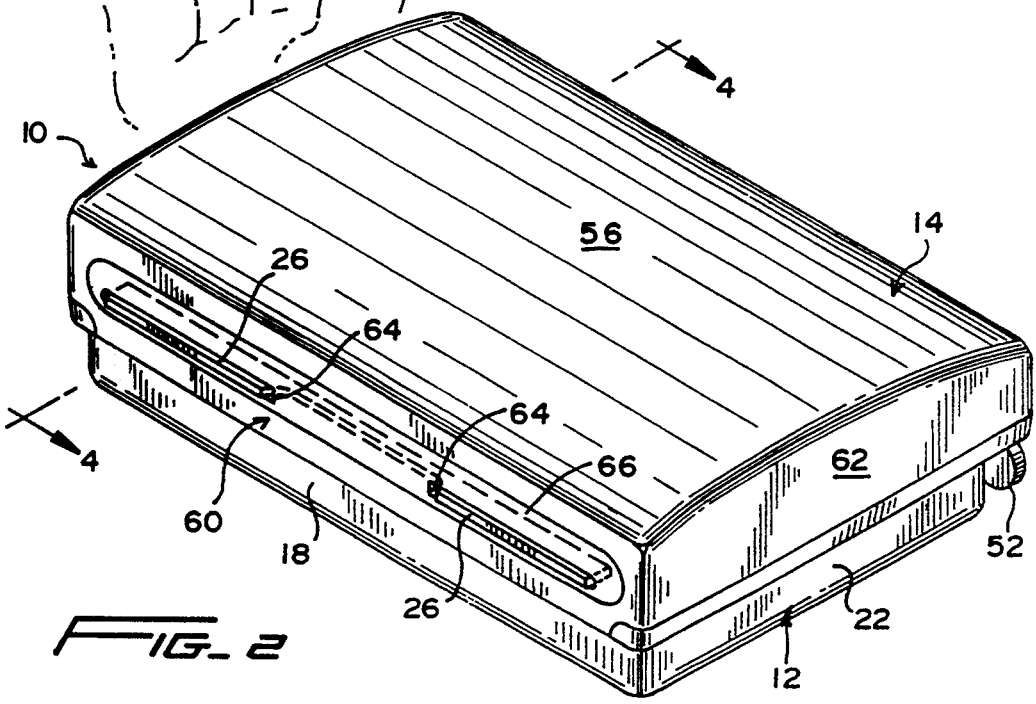
FIG. 2 is a rear perspective view.
Figure 4:
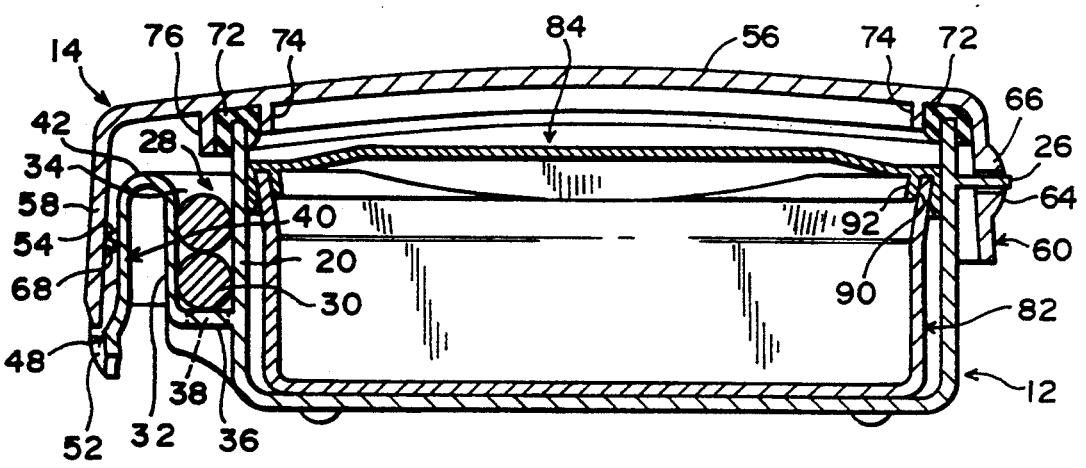
FIG. 4 is a cross sectional view taken substantially on a plane passing along line 4—4 in FIG. 2.

The rear hinge assembly, in addition to the rearwardly projecting elongate tabs 26 extending from the tray rear wall 18, further includes a pair of elongate tab-receiving slots 64 through the lid rear wall 60 at spaced longitudinally aligned locations therealong corresponding to the tray tabs 26 for reception of the tabs 26 therein and therethrough, note FIGS. 2 and 4. The rear wall 60 of the lid 14 includes a longitudinally extending integral rearwardly projecting bulbous portion 66 through which the slots 64 are defined, thus providing increased thickness for enhanced strength and stability at the hinge assembly. This bulbous portion 66 also allows for the use of relatively wide tabs 26 while at the same time protectively enclosing the tabs and avoiding an exposed projection of the tabs beyond the lid rear wall 60, both for appearance and safety advantages.

It will also be noted that the rear wall slots 64 are dimensionally slightly greater than the corresponding tray tabs 26 for a rather loose reception of the tabs therein which allows both a pivotal movement of the lid relative to the tray and a direct and simplified disengagement of the lid from the tray, all as shall be explained subsequently.

Figure 5:
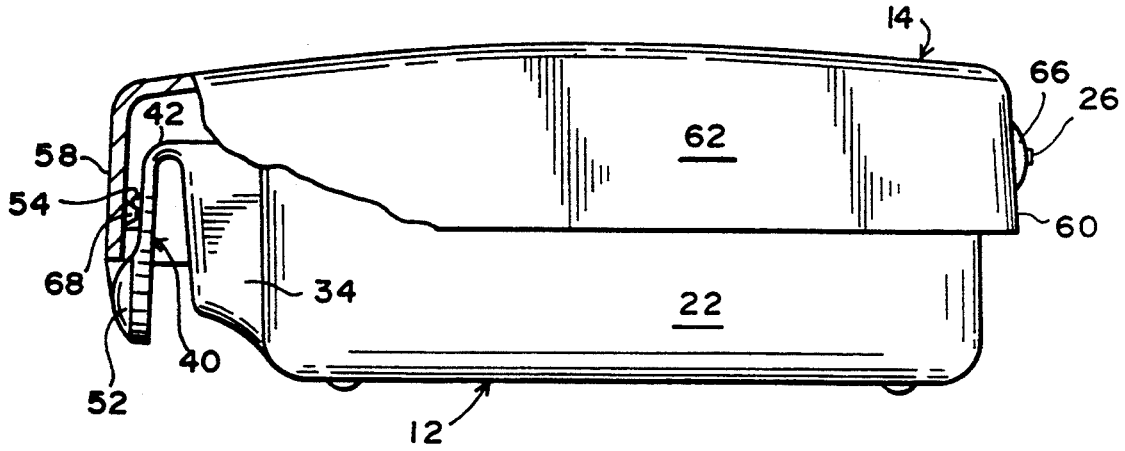
FIG. 5 is an end elevational view with a portion broken away to illustrate the latch assembly in its engaged position.

The front wall 58 of the lid 14 includes, toward the opposed longitudinal ends thereof, a pair of integral rearwardly or inwardly projecting locking lugs 68 which, upon a full seating of the lid 14 as in FIGS. 4 and 5, engage immediately below the corresponding locking lugs 54 on the front panel 40, thereby defining the latching assembly component of the lid 14.

As will now be apparent, the tray lugs 54 and lid lugs 68 act in the manner of cooperating detents which, in the normal or unflexed position of the front panel 40, retain the lid 14 in its closed and sealed position over the tray 12.

Noting FIGS. 1 and 3, the front wall 58 of the lid 14 can have the lower edge thereof, at the opposed end portions 70, slightly upwardly relieved to accommodate the circular pressure pads 52.

In order to enhance the seal between the lid 14 and the tray 12, an elastomeric gasket 72 is mounted to the under surface of the lid top wall 56 within a peripheral groove defined by a continuous depending inner flange 74 and an outer flange portion which, along the rear and side walls 60 and 62, is defined by these walls. The outer flange portion 76, associated with that portion of the gasket 72 to engage the front wall 20 of the tray 12, is separately formed in parallel inwardly spaced relation to the front wall 58 of the lid 14 to properly locate the gasket 72.

Noting FIGS. 3 and 7, to enhance the utility of the lunch box 10, the interior of the compartment within the tray 12 can include a removable divider 78 which is received transversely across the compartment between integral guide ribs 80 provided on the inner faces of the tray rear and front walls 18 and 20. In addition, a removable covered receptacle 82, preferably configured to fit to one side of the divider 78 or retaining ribs 80, can also be provided. The cover 84 of the receptacle, to provide a low profile as desired for the compact lunch box 10, will have the handle 86 thereof defined by elongate recesses 88 within the top wall of the cover 84 to the opposite sides thereof. In addition, to ensure a positive seal of the cover 84 to the container portion of the receptacle 82, the undersurface of the cover 84, noting FIG. 4, can be provided with a defined channel 90, formed by the depending walls of the cover 84 and an inwardly spaced flange 92, for reception of the upper edge portion of the container portion of the receptacle 82.

As will be noted from the drawings, the lid 14, and more particularly the top wall 56 thereof, is slightly arcuate in a front-to-rear direction. A similar slight front-to--rear arcing will also be provided on the upper edges of the side walls 22 of the tray 12 to conform with the arc of the lid wall 56 and maintain, through the sealing gasket 72, an intimate engagement therewith.

The lunch box 10, or more particularly the separate components thereof, are preferably formed of an appropriate molded synthetic resinous material, for example high density polyethylene or polypropylene, suitable for direct reception of both packaged and unpackaged foodstuffs.

In mounting the separate lid 14 on the tray 12, the lid is slightly canted relative to the tray and shifted forwardly to engage the tray tabs 26 through the lid slots 64, relying on the relatively loose fit therebetween. The lid is then downwardly pivoted with the lid gasket 72 sealing to the upper edges of the tray walls and with the detents 68 on the lid front wall 58 engaging and snapping below the detents 54 on the tray front panel 40. The lid is thus locked to the tray in a stable and secure position whereby accidental or unintentional release of the lid is effectively prevented.

In order to release and remove the lid, positive coordinated manual action is required. Specifically, both pressure pads 52 toward the opposite sides of the tray must be simultaneously or substantially simultaneously rearwardly pressed and the lid slightly upwardly shifted or pivoted to disengage the cooperating latch detents 54 and 68. As suggested in FIG. 1, the lunch box can be grasped in two hands with the thumbs simultaneously rearwardly pressing on the pressure pads 52 and the index fingers engaging under and upwardly exerting a slight pressure on the lower edges of the lid side walls. Once the lid detents 68 are shifted above the tray detents 54, the lid can be easily grasped, slightly upwardly pivoted about the rear hinge assembly, and rearwardly shifted to completely disengage the lid. As will be appreciated, with the lid completely removed, the interior of the tray is easily accessed for either removal of bulk food items or for use as a dish from which the food is directly consumed. Removal of the lid also opens the utensil pocket with the utensils being easily grasped through the front recess 44.

The foregoing described embodiment is illustrative of the invention, and as other embodiments incorporating the inventive features of the invention may occur to those skilled in the art, the disclosed embodiment is not to be considered as a limitation on the scope of the invention.

I claim:

1. A lunch box comprising a tray and a lid, said tray including opposed front and rear tray walls, said lid including opposed front and rear lid walls, said lid being removably received in a closed position over said tray with said lid front and rear walls generally paralleling said tray front and rear walls outwardly thereof respectively, hinge means on said tray and lid rear walls for engaging and defining a hinge between said tray and lid rear walls, and latch means for releasably engaging said tray and lid, said latch means including a tray latch component and a lid latch component, said lid latch component comprising a pair of lid detents on said lid front wall, said tray latch component comprising a panel joined to said tray front wall in spaced relation thereto between said tray and lid front walls, and a pair of tray detents on said panel engaged with said lid detents for retaining said lid on said tray, said panel being selectively manually flexible away from said lid front wall for disengagement of said tray detents from said lid detents for release of said lid, said panel including a pair of spaced panel portions flexibly movable inward relative to said lid front wall, said pair of tray detents comprising a detent on each panel portion extending forwardly toward said lid front wall, said pair of lid detents comprising spaced detents one aligned and engageable with each tray detent, each tray detent disengaging from the corresponding lid detent upon rearward flexing of the corresponding panel portion for release of said latch means, said hinge means comprising at least one elongate slot defined through said lid rear wall, and an elongate tab integrally projecting from said tray rear wall and slidably received within and through said slot for selective disengagement therefrom upon rearward movement of said lid relative to said tray, an upwardly opening pocket defined on said tray forward of said tray front wall and longitudinally therealong, said panel being in forwardly spaced relation to said pocket, said pocket being defined by a pocket wall generally parallel to said tray front wall and said panel, and a bottom wall between said pocket wall and said tray front wall, said panel and said pocket wall including integrally joined upper edge portions, said panel portions depending freely from said joined upper edge portions for selective manual inward movement thereabout relative to said lid front wall, said panel and pocket wall, centrally therealong, each include an upwardly opening recess therein allowing direct access therethrough to said pocket and the pocket contents for removal.

2. The lunch box of claim 1 wherein said panel comprises a single elongate panel having longitudinally opposed end portions defining said panel portions for a remote positioning of said tray detents from each other, release of said latch means requiring substantially simultaneous movement of both of said panel portions.

3. The lunch box of claim 2 wherein said lid includes a top wall having a depending sealing gasket affixed thereto and sealingly engaging said tray.

4. A lunch box comprising a tray and a lid, said tray including opposed front and rear tray walls, said lid including opposed front and rear lid walls, said lid being removably received in a closed position over said tray with said lid front and rear walls generally paralleling said tray front and rear walls respectively, hinge means on said tray and lid rear walls for engaging and defining a hinge between said tray and lid rear walls, and latch means for releasably engaging said tray and lid, said latch means including a tray latch component and a lid latch component, said lid latch component comprising a lid detent on said lid front wall, said tray latch component comprising a panel joined to said tray front wall in spaced relation thereto between said tray and lid front walls, and a tray detent on said panel engaged with said lid detent for retaining said lid on said tray, said panel being selectively manually flexible away from said lid front wall for disengagement of said tray detent from said lid detent for release of said lid, an upwardly opening pocket defined on said tray forward of said tray front wall and longitudinally therealong, said latch component panel being in forwardly spaced relation to said pocket, said pocket being defined by a pocket wall generally parallel to said tray front wall and said panel, and a bottom wall between said pocket wall and said tray front wall, said panel and said pocket wall including integrally joined upper edge portions, said panel depending freely from said joined upper edge portions for selective manual inward movement thereabout relative to said lid front wall, said panel and pocket wall, centrally therealong, each include an upwardly opening recess therein allowing direct access therethrough to said pocket and the pocket contents for removal.

5. A lunch box comprising a tray and a lid, said tray including a bottom with walls extending upwardly therefrom peripherally thereabout and defining opposed front and rear tray walls and opposed tray side walls forming a food compartment, said walls defining a continuous tray wall upper edge, said lid including a top with walls depending therefrom peripherally thereabout and defining opposed front and rear lid walls and opposed lid side walls, said lid being removably received in a closed position over said tray with said lid side, front and rear walls positioned outward of and generally paralleling said tray side, front and rear walls respectively, hinge means on said tray and lid rear walls for releasably engaging and defining a hinge between said tray and lid rear walls, said lid, in said closed position intimately engaging and sealing to said continuous tray wall upper edge, an upwardly opening auxiliary utensil pocket defined on said tray integral with and forward of said tray front wall at midheight thereon and generally longitudinally coextensive therewith, said pocket being defined by a pocket wall forward of and generally parallel to and coextensive with said tray front wall, a bottom wall between said pocket wall and said tray front wall, said bottom wall being upwardly spaced from said tray bottom, said pocket wall having an upper edge, a panel generally longitudinally coextensive with and forward of said pocket wall, said panel having an upper edge integrally joined to and along said upper edge of said pocket wall, said panel having a panel portion depending freely from said joined upper edges for selective manual inward movement thereabout toward said pocket wall and said tray front wall, said lid extending over said pocket with said lid front wall being positioned forward of said panel, a tray latch component and a lid latch component, said lid latch component comprising a lid detent on said lid front wall, said tray latch component comprising a tray detent on said panel portion engaged with said lid detent for retaining said lid on said tray, said panel portion being selectively manually flexible inwardly away from said lid front wall for disengagement of said tray detent from said lid detent for release of said lid wherein said pocket upper edge is spaced below said continuous tray wall upper edge, and said lid top including means for engaging and sealing to said continuous tray wall upper edge independently of said pocket.

6. The lunch box of claim 5 wherein said panel has first and second opposed longitudinal end portions, said panel portion comprises said first end portion of said panel, said tray detent being mounted on said first end portion, and said panel having a second duplicate panel portion defined by said second end portion of said panel and including a second tray detent, said lid including a second lid detent engaged with said second tray detent.

7. The lunch box of claim 6 wherein said hinge means comprises at least one elongate slot defined through said lid rear wall, and an elongate tab integrally projecting from said tray rear wall and slidably received within and through said slot for selective disengagement therefrom upon rearward movement of said lid relative to said tray, said slot being dimensionally greater than said tab for pivotal movement of said tab within said slot to thereby define a hinge action between said lid and said tray.

8. The lunch box of claim 5, wherein said hinge means comprises at least one elongate slot defined through said lid rear wall, and an elongate tab integrally projecting from said tray rear wall and slidably received within and through said slot for selective disengagement therefrom upon rearward movement of said lid relative to said tray, said slot being dimensionally greater than said tab for pivotal movement of said tab within said slot to thereby define a hinge action between said lid and said tray.

* * * * *